US010605001B2

(12) United States Patent
Bartole et al.

(10) Patent No.: US 10,605,001 B2
(45) Date of Patent: Mar. 31, 2020

(54) METHOD FOR CONTROLLING A DOOR ARRANGEMENT, AS WELL AS A DOOR ARRANGEMENT OF THIS KIND AND A SAFETY DEVICE THEREFOR

(71) Applicant: EFAFLEX Tor- und Sicherheitssysteme GmbH & Co. KG, Bruckberg (DE)

(72) Inventors: Dieter Bartole, Bruckberg (DE); Hans-Jörg Kremser, Bruckberg (DE); Martin Mayer, Bruckberg (DE)

(73) Assignee: EFAFLEX Tor- und Sicherheitssysteme GmbH & Co. KG, Bruckberg (DE)

( * ) Notice: Subject to any disclaimer, the term of this patent is extended or adjusted under 35 U.S.C. 154(b) by 178 days.

(21) Appl. No.: 15/545,440

(22) PCT Filed: Oct. 27, 2015

(86) PCT No.: PCT/EP2015/074898
§ 371 (c)(1),
(2) Date: Jul. 21, 2017

(87) PCT Pub. No.: WO2016/116178
PCT Pub. Date: Jul. 28, 2016

(65) Prior Publication Data

US 2018/0002980 A1 Jan. 4, 2018

(30) Foreign Application Priority Data

Jan. 23, 2015 (DE) ..... 10 2015 101 017

(51) Int. Cl.
*E05F 15/40* (2015.01)
*E05F 15/43* (2015.01)
(Continued)

(52) U.S. Cl.
CPC ..... *E06B 9/68* (2013.01); *E05F 15/40* (2015.01); *E05F 15/43* (2015.01); *E05F 15/75* (2015.01);
(Continued)

(58) Field of Classification Search
CPC ..... E06B 9/68; E06B 2009/6836; E06B 2009/6845; E05F 15/75; E05F 15/42;
(Continued)

(56) References Cited

U.S. PATENT DOCUMENTS

2005/0232469 A1* 10/2005 Schofield ..... G06K 9/00818 382/104
2009/0115366 A1* 5/2009 Mullet ..... E05F 15/41 318/466
(Continued)

FOREIGN PATENT DOCUMENTS

DE 299 12 572 U1 9/1999
DE 10 2007 050 334 A1 4/2009
(Continued)

OTHER PUBLICATIONS

Prior Art Applied translation 1.*
Prior Art Applied translation 2.*

*Primary Examiner* — Daniel P Cahn
(74) *Attorney, Agent, or Firm* — McGlew and Tuttle, P.C.

(57) ABSTRACT

A door arrangement (1), includes a safety device. A door arrangement monitoring method monitors a monitored area positioned in front of a door opening, offset and parallel to a door closing plane, and performs a failure routine when an object (6) is detected in the monitored area and there is a risk of a collision of the object (6) with a door leaf (2). A current position of the object (6), and of a leading edge (23) of the door leaf (2), are detected. A direction of movement of the door leaf (2) is detected. The failure routine is initiated as a function of the current position of the object (6) and the leading edge (23) of the door leaf (2) as well as the direction of movement of the door leaf (2).

11 Claims, 2 Drawing Sheets

(51) Int. Cl.
*E06B 9/68* (2006.01)
*E05F 15/75* (2015.01)

(52) U.S. Cl.
CPC ..... *E05F 2015/435* (2015.01); *E05Y 2400/32* (2013.01); *E05Y 2400/53* (2013.01); *E05Y 2900/106* (2013.01); *E06B 2009/6836* (2013.01); *E06B 2009/6845* (2013.01)

(58) Field of Classification Search
CPC . E05F 15/20; E05F 15/40; E05F 15/43; E05F 2015/435; E05Y 2900/106; E05Y 2400/32; E05Y 2400/53
USPC ..... 160/310; 49/26
See application file for complete search history.

(56) References Cited

U.S. PATENT DOCUMENTS

2011/0202178 A1* 8/2011 Zhen ..... B66B 13/143 700/275
2011/0271602 A1* 11/2011 Bartole ..... E06B 9/88 49/506
2013/0106601 A1* 5/2013 Leutenegger ..... E06B 9/88 340/532
2015/0259965 A1* 9/2015 Tehranchi ..... E05F 15/70 49/31
2017/0074039 A1* 3/2017 Gregoriou ..... E05F 15/74
2019/0169908 A1* 6/2019 Siewert ..... E06B 9/08
2019/0264487 A1* 8/2019 Zanolari ..... E05F 15/43

FOREIGN PATENT DOCUMENTS

DE 10 2008 017 244 A1 10/2009
DE 10 2010 017 398 B3 12/2011
DE 20 2014 101 131 U1 3/2014
EP 0 902 157 A2 3/1999
EP 0 902 158 A2 3/1999
EP 1 470 314 A1 10/2004
JP 2001-115761 A 4/2001
JP 2010-112036 A 5/2010
WO 03/064 802 A1 8/2003
WO 2010/089 503 A1 8/2010
WO 2014/040 583 A1 3/2014

* cited by examiner

METHOD FOR CONTROLLING A DOOR ARRANGEMENT, AS WELL AS A DOOR ARRANGEMENT OF THIS KIND AND A SAFETY DEVICE THEREFOR

CROSS REFERENCE TO RELATED APPLICATIONS

This application is a U.S. National Phase Application of International Application PCT/EP2015/074898, filed Oct. 27, 2015, and claims the benefit of priority under 35 U.S.C. § 119 of German Application 10 2015 101 017.8, filed Jan. 23, 2015, the entire contents of which are incorporated herein by reference.

FIELD OF THE INVENTION

The invention relates to a method for controlling a door (also including a gate) arrangement comprising a door leaf (also including a gate leaf) which is guided in lateral guides and is, driven by a drive means, movable to and fro between an open and a closed position in a door closing plane of a door opening, wherein the door arrangement comprises a safety device which monitors a monitored area at least on one side, this monitored area being positioned in front of the door opening and being offset in parallel to the door closing plane, and which performs a failure routine when an object is detected in the monitored area and hence a collision of the object with the door leaf is immanent. The invention relates further to a door arrangement of this kind and to a safety device therefor.

BACKGROUND OF THE INVENTION

It is generally known that safety measures have to be taken with automatically operable doors (and gates) so that obstacles or persons are not hit by the moving door closing edge and may be damaged or injured therewith.

For this purpose, as is well-known, contact edge protections have been arranged at the leading and/or abutting edges of automatically operated doors, which, on occurrence of a counter force, i.e. the detection of an obstacle, stop the door drive and/or even effect "relief" in the sense of a reversion (reversal) of the direction of movement.

The disadvantage of such tactile systems, i.e. of systems responding to contact with the object, consists in that contact occurs at any rate before the sensor can effect stopping and/or reversing of the direction of movement of the door drive. Possibly, at least slight injuries or damages will thus occur.

Another known safety device provides that light barriers and/or light grids consisting of a plurality of light barriers are applied within the door closing plane to produce a safety light curtain. Advantageous systems in this respect are described in EP 0 902 157 A2 and in EP 0 902 158 A2.

A system of this kind, however, requires the detection of the position of the leading edge of the door leaf so as to avoid erroneous object detection by the door leaf. For this purpose, sequential ignoring of particular light barriers is usually provided, which then enables acting with one light grid only. Examples therefor are also found in the documents WO 2014/040583 A1 and DE 20 2014 101 131 U1.

DE 10 2007 050 334 A1, however, describes a somewhat different system in which the entering of an obstacle in the door closing plane is detected due to an interruption of the detector beam, which causes the stopping and/or reversing of the motor drive. For this purpose, a detector beam is pivoted over an area of preferably 90° in the door closing plane close to a corner of the door opening by means of a distance measurement scanning detector. By means of the running time of detected distance measurement values it is detected, by comparison with previously stored limit values, whether a disturbing object is present in the monitored area, wherein the occurrence of the object results in a reduction of the running time of the detector beam. Since the optical safety system is positioned in the door closing plane here, too, the current position of the leading edge of the door leaf is also considered by means of previously determined standard values so as to avoid false alarms.

However, also these kinds of safeguarding of dangerous places in the movement area of a door leaf are, like the systems responding to contact with an object, often not sufficient for avoiding collisions in a reliable manner. If, for instance, a person approaches and the door leaf is moving at the same time, it can, due to the technologically given reaction time of the safety system, not be excluded reliably that the head of a person and the leading edge of the door leaf may collide in the course of their movements. Furthermore, a person may bump on a large area of the door leaf while it is moving, without this being detected by these known safety systems. As experience has shown, slight injuries, especially on the head, cannot always be avoided in this case.

Another possibility of safeguarding consists in applying sensors above the door opening, said sensors generating, shortly in front of the door closing plane, a safety field which reaches down to the ground and may also have a spatial depth extension. Infrared or ultrasound sensors as well as radar sensors are common for this purpose. Moreover, it is also known to detect further into the forefield of the door opening and to thus detect the approaching of objects or persons. A safe and advantageous method in this respect is described in EP 1 470 314 A1.

Motion sensors, however, have the disadvantage that they do not detect stationary objects, such as persons standing close to the door leaf Presence sensors, on the contrary, are susceptible to environmental influences and lighting conditions. Moreover, both kinds of sensors often have the problem that they do not cover the forefield in front of the door leaf completely since it is, due to the local conditions, for instance, not always possible to place the sensor optimally. It is then absolutely possibly to approach the door without being detected.

The situation is particularly problematic with door arrangements which are installed in constricted rooms and/or in applications where persons constantly work in the direct vicinity of the door. This is frequently the case, for example, with doors in a sales room and in a storage area in supermarkets. On the one hand, it is not possible here that the forefield monitoring is performed across a large area since the forefield is used as a production and storage area, and, on the other hand, these are often comparatively low doors, so that the possibilities of reaction to the closing door leaf are relatively minor here. Injuries of persons cannot always be excluded in a reliable manner in this case.

Moreover, it also happens that persons lean against a closed door leaf and are then, when the door surprisingly opens, hit on the chin or the nose, for instance, by the massive closure element. Sometimes, employees also prop themselves with their arms on the door frame while the door is open, which may possibly result in fingers being bruised in the course of the closing process.

Another specific problem has occurred with door arrangements used as emergency exits or in escape ways. Here, it is necessary that they mandatorily open when being approached, so that the escape way becomes free. This is regularly implemented by monitoring the forefield of the door. In the case of the conventional forefield sensors the above-described detection loopholes remain, so that a lateral approaching of escaping persons may be possible without this being detected. For the escaping persons especially the circumstance is a problem that, in the case of larger agglomerations of people, a knot of people may press against the door leaf and that the opening thereof is then completely prevented by the pressure.

Another known solution which guarantees suitable protection of persons or from damage to the door arrangement and/or to other things consists in applying light barriers and/or light grids consisting of a plurality of light barriers shortly in front of and behind the door closing plane and to thus produce a safety light curtain on both sides of the door leaf movement plane.

DE 10 2008 017 244 A1 moreover discloses a method and a device for controlling a vertically or horizontally moved door for protecting a door closing plane from obstacles and/or objects. For this purpose, a distance measurement scanning detector is arranged at the border of a monitored area, which provides detector beams in front of and behind the door closing plane for distance measurement and radiates them synchronously for providing a forked detector beam scanning system across the entire monitored area. The running time of these detector beams is compared with previously stored reference values, wherein the occurrence of an object in the monitored area results in a reduction of the running time, so that it may be detected in a reliable manner. Then, detector output signals are output to a control unit which causes the stopping and/or reversing of the motor drive.

But also these kinds of safeguarding of a dangerous place in the movement area of a door leaf with detection elements arranged in front of or behind the door closing plane are often not sufficient when persons approach and the door leaf is simultaneously moving. Thus, a particular reaction time of the safety system necessarily exists, so that it cannot be excluded reliably that, for instance, the head of a person and the leading edge or a large area of the door leaf possibly collide in the course of their movement. Furthermore, an immediate reversal of direction of the door leaf movement, as it is as a rule provided, may also constitute a further source of danger for the person, etc. being in the door closing area. As experience has shown, at least minor injuries due to abrasions on the head, above all on the forehead, the nose, and the ears, cannot always be avoided here.

In practice, depending on the site of installation, the dimension, and the mode of operation of the door arrangement, there are different kinds of risk situations for which respectively adapted safety systems exist. All of these, however, have their weak points, as explained above. To the extent that it is at all possible to combine the individual kinds of safety systems with each other in technical respect, this is partially also done. However, this results in a very high constructional effort with corresponding costs. Still, the risks given cannot be removed comprehensively and reliably therewith. Moreover, the conventional safety systems are, due to their relatively simply structured failure routines, adapted to always stop the door leaf movement in the case of doubt, which may result in impairments and time delays in the production process.

SUMMARY OF THE INVENTION

Starting out from this it is an object of the present invention to provide an improved method for controlling a door arrangement by means of which the endangering of persons and the risk of damage to things can be further reduced with little constructional effort. Furthermore, a correspondingly improved door arrangement and a safety device therefor are to be provided.

This object is solved by the method steps according to the invention, which serves to control a door arrangement comprising a door leaf which is guided in lateral guides and is, driven by a drive means, movable to and from between an open and a closed position in a door closing plane of a door opening, wherein the door arrangement comprises a safety device, and wherein the method provides that the safety device monitors a monitored area at least on one side, said monitored area being positioned in front of the door opening and being offset in parallel to the door closing plane, and performs a failure routine when an object is detected in the monitored area and hence a collision of the object with the door leaf is immanent. The method is characterized in particular by the steps of: detecting the current position of the object, detecting the current position of a leading edge of the door leaf, detecting the direction of movement of the door leaf, and initiating a failure routine as a function of the current position of the object and the leading edge of the door leaf as well as the direction of movement of the door leaf. The invention thus provides for the first time that the dynamic situation at the door arrangement is included in the consideration when there is the risk of collision. In particular, in accordance with the invention the relative position between the detected object and the leading edge of the door leaf is for the first time taken into account when choosing an appropriate failure routine. Moreover, in accordance with the invention the direction of movement of the door leaf is also taken into account for the first time, since considerable differences with respect to the risk potential result therefrom in detail in practice.

While conventional safety devices are restricted to detecting the mere presence of an object in the monitored area and to then implement a simple failure routine with stopping and/or reversing of the motor drive, the control method in accordance with the invention now takes for the first time the actual concrete degree of risk of the object in front of the door leaf into account. A thorough observation of the problem cases in practice in the course of the invention has shown that it is, for instance, of substantial importance whether the disturbing object, when detected in the monitored area, faces a door leaf which is still in front of the object or has already passed the object. If the first-mentioned is the case, for instance, the acute risk exists when the door leaf closes that the end plate of the door leaf hits the object frontally with its leading edge and causes substantial injuries and/or damages thereto.

If, on the other hand, the door leaf is in the course of closing and has already passed the position of the object, the risk for the object is typically lower since the object will then meet a large area of the door leaf in the case of collision. There, a person may indeed suffer abrasions or the like, but this has to be assessed as less critical than a direct collision with the leading edge of the door leaf. Also when the detected object is a thing, for instance a fork lift, damage to the large area of the door leaf indeed has to be feared, but the situation on the whole appears less critical than the hitting of the leading edge of the door leaf upon the prongs of a fork lift, for instance.

The case is different when the door leaf is in its opening movement and the door leaf leading edge has already passed the position of the object. In the course of the invention it has become known that it is not expedient then to stop the movement of the door leaf. The risk of collision does not exist in this case anyway since the door leaf is moving away from the detected object.

This choice of possible configurations or constellations reveals the advantages which the selective control of the door arrangement in accordance with the invention has in the practical operation of door arrangements. The selection of a suitable failure routine as a function of the endangering by the door leaf enables to react to the risk situation in a manner adequate for the respective situation. At the same time it is, however, also achieved that unnecessary interruptions of the operation of such door arrangements are avoided, so that interferences with the production process, etc. may be kept low. Thus, a particularly economic and practice-oriented operation of the door arrangement is possible.

This also includes particular situations with door arrangements which are used as emergency exits and in escape ways, and which are therefore intended to open at any rate if an appropriate emergency opening signal exists, and must exactly not be blocked by an automatic stop.

Moreover, the method in accordance with the invention can be performed with comparatively little technological effort. Thus, in the course of detection of the object in the monitored area it is absolutely possible with relatively low additional effort to determine its exact position in the monitored area. At the same time, the direction of movement of the door leaf can also be detected via the drive control, for instance. Furthermore, additionally the degree of closure of the door leaf and the position of its leading edge may be detected, for instance, in this manner. By a suitable pre-adjustment of the safety device with pre-programmed reaction patterns it is then possible to determine the actual risk potential and to define a suitable failure routine as a function thereof Δt the same time the control method in accordance with the invention may also be applied with door arrangements which are used in constricted rooms since no additional forefield monitoring is necessary.

The control method for a door arrangement in accordance with the invention thus takes for the first time the respective concrete risk situation into account and meets same in an economically useful manner with a view to the protection of an endangered person and also to the avoidance of damage to things.

Advantageous further developments of the method in accordance with the invention are provided by other method features. Thus, the current position of the object may be detected by using an optical detector means. An approved detection system usable with high reliability can hence be employed. Especially a light grid system is used here since it enables a particularly good areal monitoring of the desired monitored area.

Furthermore, the current position of the object may be detected based on a differing detection density in partial areas of the monitored area. This has the advantage that different risk situations can be met therewith. Thus it is, for instance, more difficult to reliably detect the hands of a person than the head since the hands take up less space. In other words, a reliable detection of hands requires a larger detection density than the detection of a head. A similar situation results, for instance, also in the case of fork lifts whose prongs are more difficult to detect than other, large-format constructions. With the proposed use of a differing detection density in the monitored area the respective concrete requirements at the operating site are thus met even better.

Moreover, it is also possible that only a partial area of the door opening is monitored for detecting the current position of the object. This is especially useful if disturbing objects in the normal operation of the door arrangement are to be expected above all only in a partial section of the door opening plane. Then, the monitoring effort will concentrate on the core area, which facilitates control.

If he failure routine initiates the stopping of the door leaf movement and/or a reversal of the direction of movement of the door leaf when the leading edge of the door leaf has not yet passed the position of the object in the course of the closing movement in the direction of movement, the hitting of the leading edge on the object can be avoided in a particularly reliable manner.

On the other hand, it is of advantage if the failure routine initiates the stopping of the door leaf movement when the leading edge of the door leaf is adjacent to the object in the course of the closing movement in the direction of movement. In this case the risk of the object bumping on the end plate and/or a large area of the door leaf exists, which is comparatively uncritical when the door leaf has been stopped. Otherwise there would be the risk of the door leaf rubbing against the object, which might result in abrasions and the like with persons and in damage to the thing and/or to the door leaf in the case of things. These problems are avoided by the measure of stopping the door leaf movement this course in accordance with the invention.

It is of further advantage if the failure routine, after a predetermined dwell time, initiates a reversal of the direction of movement of the door leaf at reduced speed when the leading edge of the door leaf is adjacent to the object in the course of the closing movement in the direction of movement and the door leaf has been stopped, since a resolution of the problematic situation is thus possible with distinctly lower risk. In this manner the business operations are impaired as little as possible.

Furthermore, the failure routine may initiate the stopping of the door leaf movement when the leading edge of the door leaf has already passed the position of the object in the course of the closing movement in the direction of movement. Then, rubbing of the door leaf against the object can be avoided in a reliable manner. Injuries of a person and/or damage to a thing can thus be avoided even more reliably.

It is of further advantage in this respect if the failure routine initiates a continuation of the movement of the door leaf in the predetermined direction of movement at reduced speed when the leading edge of the door leaf has already passed the position of the object in the course of the closing movement in the direction of movement and the object is no longer detected then. Thus, interference with the business operations can be largely avoided since the door leaf, unless in prior art, does not remain in the stopped condition or is even opened, but continues its intended movement although at reduced speed as a precaution.

Moreover, it is also possible that the failure routine initiates the stopping of the door leaf movement when an object is detected in the course of the opening movement. This avoids the rubbing of the door leaf against the object just as reliably as the impacting of the usually more massive and thicker end plate, which might result in direct damage and/or injuries of the object.

It is of further advantage in this respect if the failure routine, following the stopping of the door leaf movement, initiates an opening movement of the door leaf at reduced speed once the object is no longer detected. This again makes it possible to keep interference with the business operations particularly small.

Furthermore, it is also possible that the failure routine, despite the detection of an object, initiates an opening movement of the door leaf at reduced speed and with increased moment of force if the door arrangement serves as an escape way and an appropriate emergency opening signal exists. The advantage thereof is that the failure routine then does not become a trap for involved persons in their escape movement, but releases the passage at any rate. This increases safety for the involved persons substantially, even if a larger crowd of people accumulates in front of the door arrangement and should exert pressure on the door leaf.

In accordance with a further aspect of the present invention a door arrangement comprises a door leaf which is guided in lateral guides and is, driven by a drive means, movable to and from between an open and a closed position in a door closing plane of a door opening, wherein the door arrangement further comprises a safety device which monitors a monitored area at least on one side, said monitored area being positioned in front of the door opening and being offset in parallel to the door closing plane, and which performs a failure routine when an object is detected in the monitored area and hence a collision of the object with the door leaf is immanent. The safety device comprises means for detecting the current position of the object, means for detecting the current position of a leading edge of the door leaf, means for detecting the direction of movement of the door leaf, and control means for initiating the failure routine as a function of the current position of the object and the leading edge of the door leaf as well as the direction of movement of the door leaf. The door arrangement in accordance with the invention is characterized by a particularly good safety status, so that endangering of persons or goods and/or furniture and fixtures can be avoided in a particularly reliable manner. Moreover, the safety device of the door arrangement in accordance with the invention allows, due to the control of the failure routine as a function of the actual risk at the door leaf, a particularly practice-oriented and economic operation of the door arrangement.

Specifically, unnecessary interruptions of the operation by avoidable stopping or undesired opening movements are reliably prevented. Moreover, the door arrangement according to the invention can be provided with a comparatively low constructional effort and is characterized by high reliability.

Advantageous further developments of the door arrangement in accordance with the invention are provided by further features.

Thus, the safety device of the door arrangement may comprise at least one light grid system. This makes it possible to use a detection device which is approved in practice and is very reliable. It enables additionally a particularly suitable areal monitoring of the desired monitored area. In a particularly preferred embodiment one light grid system each may also be provided on both sides of the door opening. Then, the safety improved in accordance with the invention cannot only be achieved on one side, but on both sides. Furthermore, it is also possible that the means for detecting the current position of the object comprises a differing detection density in partial areas of the monitored area. As has already been explained above with respect to the corresponding method feature, it is thus possible to meet specific risk situations in different partial areas of the monitored area. The reliability of monitoring is thus increased again.

Moreover, the monitored area may also be just a partial area of the door opening. In correspondence with the explanations made above already with respect to the analogous method feature, it is thus possible to concentrate the monitored area on a relevant core area, which facilitates the construction of the safety device as a whole.

In accordance with a further aspect of the present invention a safety device is provided, which is intended to be used in a door arrangement. It may be provided as an independent element and be installed in door arrangements provided for this purpose and/or be retrofitted to existing door arrangements. It thus constitutes an independently manageable unit. The safety device in accordance with the invention enables to achieve the effects and advantages explained above by means of the method according to the invention and/or the door arrangement according to the invention.

The safety device in accordance with the invention may, additionally be further developed with features which are analogous to those of the door arrangement, wherein the corresponding advantageous effects are achieved.

In the following, the invention will be explained in detail in embodiments by means of the Figures of the drawing. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
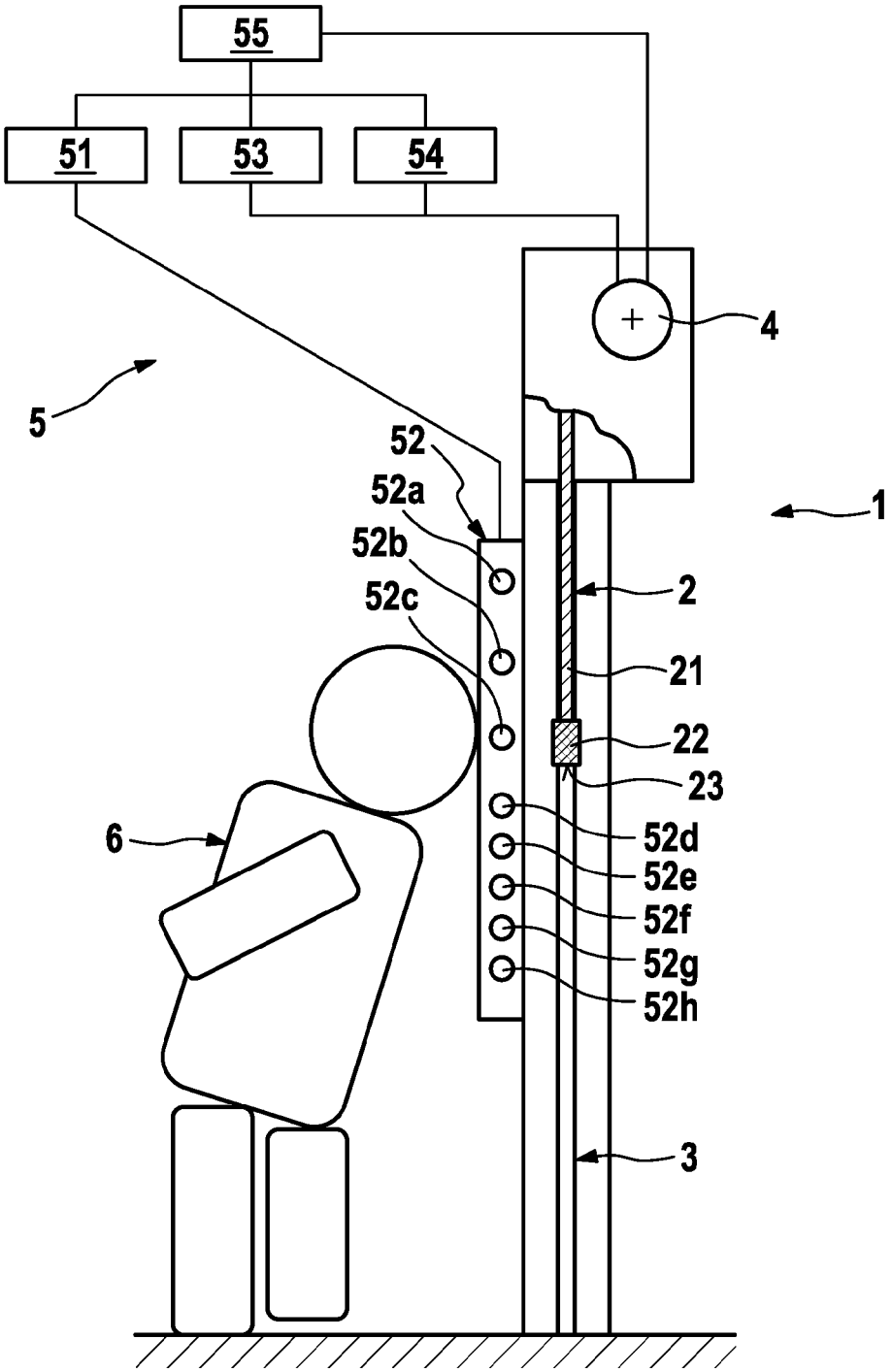
FIG. 1 is a schematic side view of a lifting door arrangement in accordance with the invention.

Referring to the drawings, in accordance with the illustration in FIG. 1 a door arrangement 1 is configured as a lifting door in the instant embodiment. It comprises a door leaf 2 which is guided in lateral guides 3, wherein only one guide 3 is shown in the schematic illustration of FIG. 1, which is partially a sectional view. The guide which is not shown is of a design analogous to that of the illustrated guide 3 and is arranged to face same, so that the door leaf 2 is accommodated between the lateral guides and is guided to be movable vertically therein.

In the open position the door leaf 2 is accommodated in the region of a door lintel in a non-illustrated spiral section as a coil. In the closed position the door leaf 2 closes the free passage space, i.e. the area of the door opening, between the lateral guides 3 completely down to the ground. The door leaf 2 comprises a lamella armor or slat assembly or roller shutter assembly 21 which is constructed of lamellae or slats or roller shutter elements connected with each other to be angled towards each other and extending transversely to the door opening. An end plate 22 follows the lowermost lamella of the door leaf 2 as a bottom-side end. The end plate is conventionally designed to be more massive than the individual lamellae and, when the door arrangement 1 is closed, it rests on the ground with a leading edge 23 formed thereon.

The door leaf 2 is driven by a drive means (door leaf drive), which is configured as an electric motor here, such that the door leaf can be moved to and fro between an open and a closed position. In the instant embodiment the drive means 4 drives a drive shaft, which is provided in the lintel region and is not illustrated in detail here, in the desired direction of rotation so as to move the door leaf 2 between two door leaf end positions.

The door arrangement 1 moreover comprises a safety device 5 monitoring a monitored area which is positioned in front of the door opening and is offset in parallel to the door opening plane, so as to avoid a collision of an object 6 with the door leaf 2 or at any rate to limit the consequences of such collision.

The safety device 5 comprises a plurality of detection means which are linked with one another and in the instant embodiment also with the drive means 4.

Thus, the safety device 5 comprises an object detecting means 51 for detecting the current position of a detected object 6, which uses data of a light grid system 52 in the instant case.

The light grid system 52 defines the monitored area with respect to the door closing plane. As may be seen from FIG. 1, in the instant embodiment the monitored area is restricted in the height of the door opening to a partial area of the door closing plane.

The light grid system 52 comprises a plurality of light barriers 52*a* to 52*h*, each comprising a sender and a receiver, which are positioned on both sides of the door opening and face each other. In the illustrated embodiment the light barriers 52*a*, 52*b*, 52*c*, and 52*d* have a larger distance from each other than the light barriers 52*d*, 52*e*, 52*f*, 52*g*, and 52*h*. Accordingly, the detection density is lower in the head region of the object 6, which is illustrated as a person here, than in the region of the upper part of the body of the object 6, in which mostly also the hands of the person involved may get into danger.

The distance of the light grid system 52 from the door closing plane, i.e. the movement plane of the door leaf 2, is dimensioned such that this distance is as small as possible, on the one hand, to keep the overall size of the door arrangement 1 restricted, and permits a preferably early detection of an object 6, on the other hand. In practice, the concrete circumstances at the site of operation of the door arrangement 1 and the dimension and movement speed of the door leaf 2 alike play a substantial role.

Typically, the distance of the light grid system 52 from the movement plane of the door leaf 2 lies in a range of between 10 cm and 50 cm. In particular application cases, however, other distances may also be chosen. Furthermore, the safety device 5 comprises a door leaf leading edge detecting means 53 for detecting the current position of the leading edge 23 of the door leaf 2, which obtains its data from the drive means 4 in the instant embodiment. For this purpose, rotation angle data of the drive means 4 in comparison to a zero position with a completely closed door are referred to so as to detect the position of the leading edge 23.

Moreover, the safety device 5 comprises a door leaf direction of movement means 54 for detecting the direction of movement of the door leaf 2. This means 54 also uses data of the drive means 4 so as to detect the direction of movement of the door leaf by means of the direction of rotation thereof.

The safety device 5 further comprises control means 55 which takes and evaluates the data of the means 51, 53, and 54. If an object 6 was detected, the control means initiates a suitable failure routine as a function of the current position of the object 6, the current position of the leading edge 23 of the door leaf 2, and the direction of movement of the door leaf 2. Its concrete configuration depends on the three parameters mentioned and thus directly meets the respective risk situation in front of the door leaf 2. The control means 55 controls the drive means 4 in a suitable manner for this purpose.

Figure 2:
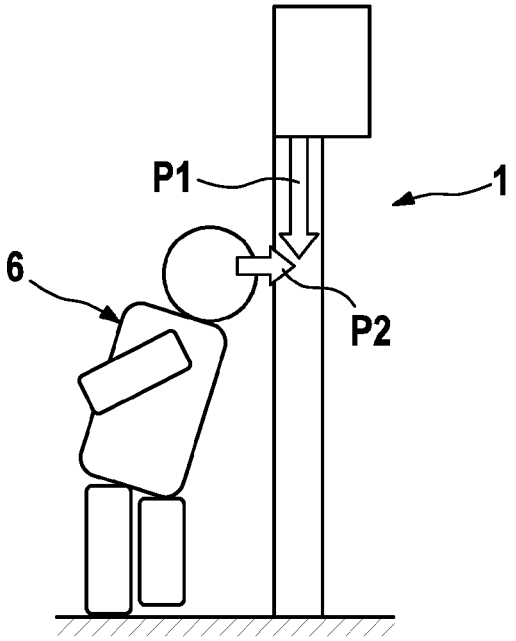
FIG. 2 is a schematic representation of one of possible risk scenarios.
Figure 3:
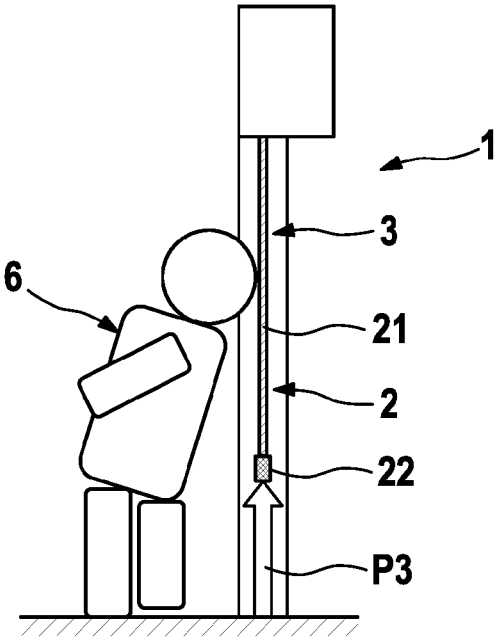
FIG. 3 is a schematic representation of another of possible risk scenarios.
Figure 4:
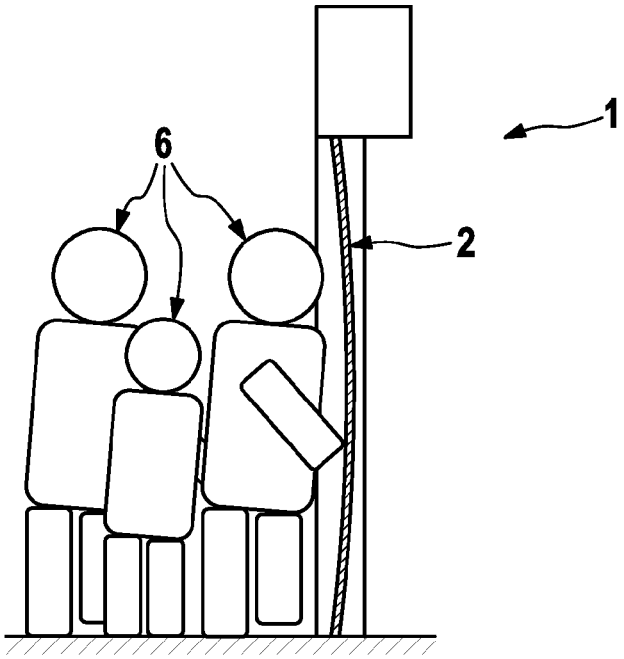
FIG. 4 is a schematic representation of another of possible risk scenarios.

FIGS. 2 to 4 schematically illustrate three examples of possible risk situations.

FIG. 2 illustrates a situation in which the door leaf 2, which is not shown in detail here, is in a closing movement, which is illustrated by an arrow P1. The door leaf 2 is positioned just above the object 6. At the same time, the object 6 moves toward the door closing plane, which is illustrated by a further arrow P2. In such a situation, grave injuries of the object 6, which is illustrated as a person here, may be caused by the leading edge 23 of the door leaf 2. In this case the control means 55 will initiate the immediate stopping of the door leaf 2 and, as a rule, also a speedy reversal of the direction of movement of the door leaf 2.

FIG. 3 illustrates a situation in which the object 6 is detected while the door leaf 2 is moved to its open position. This is illustrated by an arrow P3. Thus, there is the risk that the object 6, which is identified as a person in the instant case, suffers abrasions by the lamella armor 21 sliding past the head. Moreover, even graver injuries may be caused by the fact that the, as a rule, somewhat thicker end plate 22 of the door leaf 2 bumps with an edge on the head of the object 6. In this case the movement of the door leaf 2 is immediately stopped by the control means 55. Only when the means 51 detects that the object 6 has left the monitored area is a continuation of the opening movement at reduced speed permitted.

FIG. 4 illustrates a panic situation in front of a door arrangement 1 which serves as an escape way, wherein the door leaf 2 is closed and a plurality of objects 6, here a plurality of persons, push against the door leaf 2. If an emergency opening signal for the door arrangement 1 exists, it is necessary that the escape way opens nonetheless for avoiding further endangering of the objects 6. The control means 55 then initiates, in response to this emergency opening signal, an opening movement of the door leaf 2 at reduced speed and with increased moment of force through the drive means 4. This is initiated although persons push against the door leaf 2 since the injuries to be feared, such as abrasions, etc. are generally less critical than the actual risk situation, for instance a fire, which caused the persons to escape. As may be gathered from these example cases, the control means 55 of the safety device 5 is configured such that it is adapted to initiate, on the basis of the determined parameters concerning the current position of the object 6, the current position of the leading edge 23 of the door leaf 2, and the direction of movement of the door leaf 2, a reaction with respect to the door leaf movement which is adequate for the risk situation. Such reaction patterns are pre-programmed in the control means 55 and may then be chosen automatically as a function of the parameters and be triggered at the drive means 4.

In the following, a scheme (algorithm) for user-specifically programmable reaction patterns of the control means 55 is illustrated by way of example:

I. Course of events during the closing process of the door leaf 2:

door arrangement 1 is open closing instruction is given all safety systems are free, otherwise closing will not take place—closing process starts interruption of at least one light beam of the light grid system 52 door leaf 2 above the head protection area (light barriers 52*a* to 52*d*) of the monitored area? then continue with step A door leaf 2 within the head protection area (light barriers 52*d* to 52*h*) of the monitored area? then continue with step B door leaf 2 within the bruise protection area for fingers of the monitored area? then continue with step C door leaf 2 below the monitored area? then continue with step D.

Step A: Stopping of the door leaf 2 and speedy reversing process, automatic restart of the closing process Step B: Stopping of the door leaf 2, dwell time and decelerated reversing process, waiting for new closing instruction Step C: Stopping of the door leaf 2, dwell time and decelerated reversing process if the light grid above is also free Step D: Stopping of the door leaf 2 and decelerated closing process of the door leaf 2 after release of the light grid system 52.

II. Course of events during the opening of the door leaf 2:

door arrangement 1 is closed opening instruction is given light grid system 52 is free, otherwise opening will not take place interruption of a light beam of the light grid system 52 stopping of the opening movement of the door leaf 2 release of the light beam—continuation of the opening movement of the door leaf 2 at reduced speed.

III. Panic prevention at a door arrangement 1 in escape ways:

Starting situation a:

door arrangement 1 is closed light grid system 52 does not respond (no object close to the door leaf 2 detected)

opening instruction from arbitrary controller door arrangement opens at predetermined maximum speed.

Starting situation b:

door arrangement 1 is closed light grid system 52 responds (i.e. a person is close to the door leaf 2, possibly a crowd of people)

immediate opening of the door leaf 2 at reduced speed and with increased moment of force.

The illustrated scheme (provided algorithm) of reaction patterns of the control device 55 is exemplary for most applications. In specific situations, however, deviations may be necessary for the protection of objects 7 and/or the components of the door arrangement 1, which will have to be programmed individually in the control means 55.

In addition to the explained embodiment the invention allows further configuration approaches.

It goes without saying that the explained door arrangement is not restricted to a roller shutter and/or a lifting door. Instead, the invention may readily also be used with some other kind of door arrangement and also in some other orientation of the door closing plane in which a door leaf is moved in a corresponding manner. Moreover, the door arrangement may also a small door arrangement or the like. Preferably, however, the door arrangement is configured as a quickly moving industrial door, especially an industrial lifting door.

The door leaf may be formed of lamellae, slats, roller shutter elements, sections, or as a one-piece door leaf. Accordingly, it is not necessary that the door leaf 2 is available as a coil in the door lintel in the open position. Instead, it may also be guided to extend flatly.

The current position of the object may also be detected by some other kind than by an optical detector means. It is, for instance, also possible to use ultrasonic sensors, radar sensors, or the like. Likewise, a detector beam system, as it has e.g. become known from DE 10 2008 017 244 A1, may also be used for the detection of an object.

Moreover, the means for detecting the current position of the object may, in a simplified embodiment, also comprise an even distribution of the detection density across the entire monitored area.

As was explained, the monitored area may be a partial area of the door opening. In an alternative embodiment, however, the entire area of the door opening may also be monitored.

If the position of the leading edge 23 of the door leaf 2 is detected on the basis of the rotation angle at the drive means 4, the end position of the door leaf 2 in the open state may also be used as a zero point here. Alternatively, the detection of the position of the leading edge 23 of the door leaf 2 may also be performed by separate sensors independently of the drive means 4. Thus, for instance, a specific detection unit may be arranged in the region of a guide 3, which responds to a chip in the end plate 22 and thus determines the position thereof.

Likewise, the direction of movement of the door leaf 2 may also be detected by appropriate sensor elements especially in the region of the guides 3, so that no access to the rotation direction data of the drive means 4 is necessary then.

The triggering of the drive means 4 in a detected risk situation may, instead by the direct access of the control means 55, also be performed indirectly via a system control unit of the door arrangement, for instance. Other suitable trigger possibilities may also be used.

While specific embodiments of the invention have been shown and described in detail to illustrate the application of the principles of the invention, it will be understood that the invention may be embodied otherwise without departing from such principles.

The invention claimed is:

1. A safety device for a door arrangement comprising a door leaf configured to be guided in lateral guides and is configured to be driven by a drive means movable between an open and a closed position in a door closing plane of a door opening, wherein the safety device monitors a monitored area at least on one side, said monitored area being positioned in front of the door opening and being offset in parallel to the door closing plane, and the safety device performs a failure routine when an object is detected in the monitored area and a collision of the object with the door leaf is immanent, wherein the safety device comprises:

an object detecting means for detecting a current position of the object;

a leading edge detecting means for detecting a current position of a leading edge of the door leaf;

a door leaf direction detecting means for detecting a direction of movement of the door leaf; and a control means for initiating the failure routine as a function of the current position of the object and the current position of the leading edge of the door leaf as well as the direction of movement of the door leaf, wherein the failure routine, after a predetermined dwell time, initiates a reversal of the direction of movement of the door leaf at reduced speed when the leading edge of the door leaf is positioned adjacent to the object during a closing movement in the direction of movement, wherein the failure routine initiates a stopping of the door leaf movement when the leading edge of the door leaf has already passed the position of the object during the closing movement in the direction of movement.

2. The safety device according to claim 1, wherein the object detecting means comprises at least one light grid system on a first lateral side and a second lateral side of the door opening.

3. The safety device according to claim 1, wherein the object detecting means for detecting the current position of the object comprises a device for detecting or setting differing detection densities in partial areas of the monitored area.

4. The safety device according to claim 1, wherein the monitored area is only a partial area of the door opening.

5. The safety device according to 1, wherein the control means initiates the failure routine based on a vertical distance between the object and the leading edge of the door leaf.

6. A door arrangement comprising:

a door leaf drive;

lateral guides;

a door leaf configured to be guided in the lateral guides and is configured to be driven by the door leaf drive and movable between an open position and a closed position, in a door closing plane of a door opening;

a safety device configured to monitor a monitored area at least on one side, said monitored area being positioned in front of the door opening and being offset thereto and disposed in parallel to the door closing plane, and the safety device performing a failure routine when an object is detected in the monitored area and a collision of the object with the door leaf is immanent, wherein the safety device comprises: an object detecting means for detecting a current position of the object, a leading edge detecting means for detecting a current position of a leading edge of the door leaf, a door leaf direction detecting means for detecting a direction of movement of the door leaf, and a control means for initiating the failure routine as a function of the current position of the object and the current position of the leading edge of the door leaf as well as a detected direction of movement of the door leaf, wherein the failure routine, after a predetermined dwell time, initiates a reversal of the direction of movement of the door leaf at reduced speed when the leading edge of the door leaf is positioned adjacent to the object during a closing movement in the direction of movement, wherein the failure routine initiates a stopping of the door leaf movement when the leading edge of the door leaf has already passed the position of the object during the closing movement in the direction of movement.

7. The door arrangement according to claim 6, wherein the object detecting means comprises at least one light grid system on a first lateral side and a second lateral side of the door opening.

8. The door arrangement according to claim 6, wherein the object detecting means for detecting the current position of the object comprises a device for detecting or setting a differing detection density in partial areas of the monitored area.

9. The door arrangement according to claim 6, wherein the monitored area is only a partial area of the door opening.

10. The door arrangement according to 6, wherein the control means initiates the failure routine based on a vertical distance between the object and the leading edge of the door leaf.

11. A method for controlling a door arrangement, the method comprising the steps of:

providing the door arrangement of claim 6; and performing the failure routine.

* * * * *